US007294314B2

(12) United States Patent
Graham

(10) Patent No.: US 7,294,314 B2
(45) Date of Patent: Nov. 13, 2007

(54) HEAT EXCHANGERS WITH NOVEL BALL JOINTS AND ASSEMBLIES AND PROCESSES USING SUCH HEAT EXCHANGERS

(76) Inventor: Robert G. Graham, 6027 E. Grand Lake Rd., Presque Isle, MI (US) 49777

( * ) Notice: Subject to any disclaimer, the term of this patent is extended or adjusted under 35 U.S.C. 154(b) by 613 days.

(21) Appl. No.: 10/657,307

(22) Filed: Sep. 8, 2003

(65) Prior Publication Data

US 2005/0051299 A1 Mar. 10, 2005

(51) Int. Cl.
*C09C 1/00* (2006.01)

(52) U.S. Cl. ..... 422/156; 422/105; 422/111; 422/158; 422/153; 423/458; 423/449.1; 423/450; 423/460; 423/461; 423/456; 239/426; 239/413; 239/424

(58) Field of Classification Search ..... 422/150–200
See application file for complete search history.

(56) References Cited

U.S. PATENT DOCUMENTS 1,429,149 A 9/1922 Lawrence
1,813,125 A 7/1931 Robinson
1,974,402 A 9/1934 Templeton
3,019,000 A 1/1962 Bork
3,406,752 A 10/1968 Lion
3,431,370 A 3/1969 Crosby
3,675,710 A 7/1972 Ristow
3,861,885 A * 1/1975 Schora ..... 44/574
3,923,314 A 12/1975 Lawler et al.
4,005,514 A 2/1977 McCloskey
4,018,209 A 4/1977 Bonvicini
4,106,556 A 8/1978 Heyn
4,122,894 A 10/1978 Laws
4,279,293 A 7/1981 Koump
4,449,575 A 5/1984 Laws
4,632,181 A 12/1986 Graham
5,979,543 A * 11/1999 Graham ..... 165/134.1

* cited by examiner

*Primary Examiner*—Glenn Caldarola
*Assistant Examiner*—Vinit H. Patel
(74) *Attorney, Agent, or Firm*—Robert L. McKellar; McKellar IP Law, PLLC

(57) ABSTRACT

What is disclosed herein deals with low to medium pressure, high temperature, all ceramic, air-to-air, indirect heat exchangers, novel ball joints, high load-bearing ceramic tube sheets, and tube seal extenders for ceramic tubes that are useful in such heat exchangers. Also disclosed are new and novel systems used in new and novel industrial processes such as chemical processing, sludge destruction and the production of particulates such as, for example, carbon black. Systems utilizing several heat exchangers are also disclosed.

6 Claims, 5 Drawing Sheets

HEAT EXCHANGERS WITH NOVEL BALL JOINTS AND ASSEMBLIES AND PROCESSES USING SUCH HEAT EXCHANGERS

The invention disclosed and claimed herein deals with low to medium pressure, high temperature, all ceramic, air-to-air, indirect heat exchangers, novel ball joints, high load-bearing ceramic tube sheets, and tube seal extenders for ceramic tubes that are useful in such heat exchangers. Also disclosed are new and novel systems used in processes that are used in the heat exchangers of this invention. The inventor herein also contemplates systems utilizing several heat exchangers or systems comprising heat exchangers within the scope of this invention.

The heat exchangers of this invention are not merely modified standard heat exchangers that are in use today, but are new and novel heat exchangers that have outstanding efficiencies in operation, among other valuable benefits. In many industrial processes, the heat exchangers of this invention reduce substantially, the combustion products going out the stack that means that from an environmental perspective, there is less material being added to the air. Also, it will be observed from the discussion infra, that there is significantly less $NO_x$ than standard industrial processes, as the process of the instant invention that deals with sludge destruction provides for a pre-drying of the wet sludge, which enables one to reduce the temperature on the furnaces, and prevent the formation of the $NO_x$. Further, they have reduced tube-to-seal and tube sheet-to-shell leakage by a significant amount by use of the novel forced air cooled expansion joints for the tube sheets which allows the use of castable refractory up to the shell, thus eliminating the use of soft insulation or open expansion joints that would normally leak. Also used are novel ball joint assemblies and dense, interlocked, refractory tube sheets that are manufactured from castable refractory materials. The novel heat exchangers of this invention therefore further reduce the tube-to-tube sheet leakage by a significant factor and reduce the tube sheet-to-tube shell leakage by a significant factor. The entire manufacturing and assembly cost for tube sheets and tubes for these heat exchangers is reduced by over twenty-five percent as compared to the cost of manufacturing and assembly of the prior art heat exchangers. Further, the heat exchangers of the present invention are significantly safer as one does not lose any ability to replace individual tubes as the tubes can be replaced from outside of either tube sheet without requiring anyone to go inside the furnace. Further, the heat exchangers of the present invention do not lose any ability to replace individual tubes. Finally, it is contemplated within the scope of this invention to use the heat exchangers of this invention in various chemical processes, especially in conjunction with the state of the art metal air-to-air heat exchangers so that the process temperatures, in industries such as chemicals, carbon black processing, and destruction of sludge, can be increased above the 1600° F. limit of metal exchangers.

Such processes contemplated within the scope of this invention include, but are not limited to, sludge destruction, carbon black production, and conversion of methane into methanol.

Thus, it is one object of this invention to provide heat exchangers having the advantage of significantly reduced leakage of air that is essential in chemical processing. This reduced leakage allows for usage of higher pressures and essentially prevents mixing of the dirty air with clean air.

It is yet another advantage of this invention to provide heat exchangers having the benefits of reduced cost of manufacturing and assembly, and it is still another object of this invention to provide heat exchangers which can be used with low to medium pressures and high temperatures where required.

BACKGROUND OF THE INVENTION

Indirect, air-to-air ceramic or metal heat exchangers are devices that are used to extract thermal energy from a dirty heated gas and provide that thermal energy to a wide variety of diverse applications such as heating clean ambient air, liquids, chemical processes, and similar uses. The source from which the extraction is made is usually waste gas of some kind, such as hot waste fumes from an industrial furnace or the like.

In general, conventional shell and tube heat exchangers utilize a series of tubes supported at their ends by what is known in the art as tube sheets. Ambient air flows through, or is forced through the tubes, and a cross flow of the hot gases, usually waste gases, is passed in a cross flow over the outside surface of the tubes to heat the air flowing through them. This is the concept of "heat exchange".

Some conventional types of heat exchangers employ metal tubes that are welded at their ends to a supporting metal tube sheet. These metal heat exchangers are subject to deterioration from chemically corrosive or abrasive particles and further, they are subject to wide latitudes of expansion under operating conditions.

Conventional heat exchangers employing ceramic components have been used in the past in these types of adverse environments. One type of heat exchanger in this category employs a sponge or matrix made of ceramic material. The particulates in the waste fumes have a tendency to plug the matrix after a period of time thereby decreasing the efficiency and, in some instances, creating a fire hazard.

Yet another type of heat exchanger employs metallic springs pushing against one end of the ceramic tube or tube sheet in an effort to provide sealing engagement between the tube and the supporting tube sheet. Systems employing metal components to seal ceramics are subject to leakage problems since metal has a different rate of expansion than ceramic. In addition, the metallic components are still subject to deterioration under the above-mentioned adverse conditions in which these types of heat exchangers may be used. Also, in the likely event of power failure, the metallic springs will lose resiliency and will fail when air side cooling stops.

Most of the known heat exchanger designs employ straight sided tubes which empty into plenums formed between the supporting tube sheets and the inner wall of the external housing or casing. The plenums are designed to carry the ambient air to other zones in the internal heat exchanger construction employing another set of tubes for passing the air back through the central chamber through which the heated waste fumes flow. Thus, the heat exchangers are normally stacked or otherwise fastened together to increase the operating flow length of both the ambient air and the waste gas and the flow of the ambient air between the plenums and tubes creates a pressure loss within the system. These pressure losses must be overcome by an increase in the horsepower of the fans for moving the ambient air in order to maintain a given velocity of the ambient airflow. These pressure losses also make it difficult to operate at higher pressures, and consequently, the heat exchangers of the prior art are not operated at the high pressures, or if attempts are made to do so, there is severe leakage. These pressure losses also make it difficult to maintain an airtight seal from the ambient air side to the gas side subsystem. The resultant leakage that may occur not only decreases the flow of the ambient air, but also allows air to flow into the fumes to reduce overall heat transfer efficiency. Also, there is an acute operating temperature loss in the heat exchanger with this type of arrangement. Air Side temperatures at operation of the prior art heat exchangers range from about 800° F. to about 1200° F., while the temperatures permitted by the use of the heat exchanger of the instant invention can range from 800° F. to 2200° F. Further, the pressures at operation of the prior art ceramic heat exchangers range from 0.25 psig to 2 psig, while the pressures permitted by the use of the heat exchanger of the instant invention can range from slightly above zero psig to 15 psig. Therefore, for purposes of this invention, what is meant by "low to medium pressure" are pressures in the range of slightly above zero psig to 15 psig, and what is meant by "high temperatures" are temperatures in the range of 1800° F. to 2800° F.

One of the most egregious forms of inefficiency in heat exchangers occurs in the connections of the tubes to the tube sheets, wherein leakage is usually of a high volume. In addition, the tube sheet itself is subject to expansion and when it expands, it expands in an uncontrolled manner that causes the tube sheet to move out of alignment, and thus cause more leakage. The prior art tube sheets also have a problem, in that, the tiles are manufactured such that they contain only one half of a tube opening in them and thus, that means many tube tiles have to be mortared together to obtain a tube sheet. Since these mortared joints micro crack under operating conditions, the more mortar joints that are used in a heat exchanger, the more leaks that occur in the tube sheets. Means of overcoming some of these prior art problems have been set forth and discussed in U.S. Pat. No. 5,979,543 that issued on Nov. 9, 1999 in the name of the inventor herein. That disclosure shows the use of a novel ball joint that is comprised of a spherical ball that has a first opening and a second opening such that a shoulder is created in the interior of the ball joint against which the end of a ceramic tube is seated. The reason for the second, larger diameter opening on the tube side of the ball is so that the sloping walls of the opening can be incorporated and thus provide a mechanism by which the tube can move without breaking the tube. Moreover, it should be noted that the end of the ceramic tube is in the interior of the ball, and does not extend through the ball.

The heat exchangers of the prior art that are subject to many of the problems set forth above can be found in one or more of the following patents: U.S. Pat. No. 1,429,149, U.S. Pat. No. 1,974,402, U.S. Pat. No. 3,019,000, U.S. Pat. No. 3,675,710, U.S. Pat. No. 3,923,314, U.S. Pat. No. 4,018,209, U.S. Pat. No. 4,106,556, U.S. Pat. No. 4,122,894, U.S. Pat. No. 4,449,575, and U.S. Pat. No. 4,632,181, and the United Kingdom patents, 191,175, issued in January, 1923, and 2,015,146, issued in September of 1979.

One notable publication dealing with the flexible ball joint system of this invention in which ceramic heat exchanger tubes are connected to tube sheets is that entitled "FLEXIBLE BALL JOINT SYSTEM", dated Apr. 11, 1995 in which there is shown a flexible ball joint system sold by Sonic Environmental Systems, Inc. wherein there is shown in an exploded view, a outside tile, a ball seal, a collar and a ceramic tube. This assembly has a slip surface between the tube and the ball seal. The tube slides in and out of the seal due to thermal expansion.

THE INVENTION

The invention disclosed and claimed herein deals with heat exchangers with novel ball joints and assemblies and processes using such heat exchangers, and systems comprising several heat exchangers or systems comprising heat exchangers that are fabricated such that they provide more efficient heat exchanges then has been possible heretofore. The invention disclosed and claimed herein also deals with chemical processing using the heat exchangers of this invention, and yet a further embodiment, deals with chemical processing using the heat exchangers of this invention in conjunction with conventional metal air-to-air heat exchangers to provide a process in which the metal air-to-air heat exchangers have enhanced benefits.

More specifically, this invention deals in one embodiment with a novel, all-ceramic slidable ball joint assembly for use in an all-ceramic, air-to-air, indirect heat exchanger.

The ball joint assembly comprises in combination a spherical body having an outer surface and an inner surface and having a near side and a tube side. The near side and tube side have a center point while the near side has a truncated face to form a flat surface on the near side. The spherical body has an opening of predetermined length through its center point from the near side through the tube side, to accommodate the end of a ceramic tube that has been reduced in diameter at its end.

The tube side has a truncated face to form a flat surface on the tube side. The outer surface of the spherical body is covered with a thin, soft woven ceramic fabric.

There is a ceramic tube having a predetermined outside diameter that is larger in diameter than the opening in the spherical body, one end of the ceramic tube being insertable into the opening of the spherical body. The end of the ceramic tube that is insertable in the opening of the spherical body is of a diameter smaller than the diameter of the opening in the spherical body, the length of the smaller diameter on that end, being equivalent to the predetermined length of the opening in the spherical body.

There is also claimed herein a novel all-ceramic slidable ball joint system comprising the slidable ball joint described supra, in combination with a tube sheet; an inner tile; an outside tile, and at least one friable, crushable, annular gasket, all of which are ceramic bodies. The tube sheet is discussed in detail infra.

In this system, the inner tile forms part of a tube sheet. The inner tile is an all-ceramic unitary structure and has at least one round opening through it and has an outside tile side and a tube side and an inside surface. The inner tile has a first engagement and closure means on the interior surface formed by the opening and near the outside tile side. The inner tile has an arcuate notch in the near end and in the interior surface. The arcuate notch mates essentially with the spherical body outer surface.

The outside tile has an outside tile top surface, an interior surface, a near end, a distal end and a vertical midpoint, there being a second engagement and closure means in the outside tile top surface to accommodate and mate with the first engagement and closure means of the inner tile. The outside tile has a second arcuate notch in the near end and in the outside tile interior surface. The second arcuate notch mates with the spherical body outer surface and the outside tile has a curved face at its distal end which begins at near the outside tile interior surface and near the vertical midpoint and ends at the outside tile distal end near the outside tile top surface. The near side of the spherical body and the outside tile interior surface near the spherical body form a channeled opening between them.

There is a friable, crushable, gasket. The gasket is located in the channeled opening.

In combination then, included in this invention is an all-ceramic, air-to-air, indirect heat exchanger which comprises in combination: a novel, all-ceramic slidable ball joint assembly for use in an all-ceramic, air to air, indirect heat exchanger, said ball joint assembly comprising in combination a spherical body having an outer surface and an inner surface and having a near side and a tube side. The near side and tube side has a center point. The near side has a truncated face to form a flat surface on the near side and the spherical body has an opening of predetermined length through its center point from the near side through the tube side to accommodate a ceramic tube in it.

The tube side has a truncated face to form a flat surface on the tube side and the outer surface of the spherical body is covered with a thin, soft woven ceramic fabric.

The ceramic tube has a predetermined outside diameter that is larger in diameter than opening in the spherical body. One end of the ceramic tube is insertable into the opening of the spherical body. The end of the ceramic tube that is insertable in the opening of the spherical body has a diameter smaller than the diameter of the opening in the spherical body, the length of the smaller diameter on the end being equivalent to the predetermined length of the opening in the spherical body.

A further part of the combination is a system comprising: a tube sheet; an inner tile; an outside tile, and at least one friable, crushable, annular gasket, wherein all of these parts are ceramic bodies and wherein the tube sheet is described in detail infra. The inner tile and outside tile are as described supra.

Yet another embodiment of this invention includes a tube seal extender in combination with the other novel parts of this invention that comprises a novel, all-ceramic slidable ball joint assembly for use in an all-ceramic, air-to-air, indirect heat exchanger. The ball joint assembly is as described above except for the tube seal extender. The tube seal extender has a tubular configuration and has a near end and a distal end.

The tube seal extender has a predetermined outside diameter on its near end which is smaller than the diameter of the second opening in the spherical body and the tube seal extender is insertable into the second opening of the spherical body and mates with the inner surface of the spherical body.

The tube seal extender distal end has a pre-determined outside diameter that is smaller than the interior surface of the ceramic tube, which distal end is insertable into the ceramic tube and mates with the interior surface of the ceramic tube.

The near end of the tube seal extender compresses a friable, crushable, annular gasket that is located between the near end and the shoulder located in the second opening of the spherical body.

There is further provided in this invention an all-ceramic, air-to-air, indirect heat exchanger that is a combination of a plurality of all-ceramic slidable ball joint assemblies for use in an all-ceramic, air-to-air, indirect heat exchanger. Each ball joint assembly is as described supra.

There are at least two tube sheets (B) and there is an inner tile for each slidable ball joint. There is also an outside tile (D) for each slidable ball joint and at least one friable, crushable, annular gasket (E) for each slidable ball joint.

The components (B), (C), and (D) are ceramic bodies and each of the tube sheets is dislocated some distance from the other tube sheet and each tube sheet supports the slidable ball joint assemblies in them.

The inner tile and the outside tile are as described supra.

Yet another embodiment of this invention is a forced-air cooled tube sheet assembly. The tube sheet assembly comprises (I) a silicon carbide tube sheet having either a round, square, or rectangular configuration with an outside edge and containing a plurality of circular openings transversely therethrough wherein each traverse opening has contained therein an all ceramic ball joint assembly.

It also comprises (II), the tube sheet being supported by a first firebrick wall that is a combination of firebrick at the outside edge of the tube sheeting and surrounding the entire outside edge. The combination of firebrick in combination with the outside edge of the tube sheet forms a channel, there being located in the channel, a ceramic, crushable gasket.

Component (III) is a second firebrick wall interfacing with the first firebrick wall and covering substantially the outside surface of the first brick wall leaving an opening at the point that the first firebrick wall supports the tube sheet.

There is (IV), a steel shell essentially surrounding the second firebrick wall. The steel shell has an inside surface and an outside surface, the combination of the tube sheet, first brick wall, second brick wall, and the steel shell form a second channel. The channel is filled with a refractory material that may contain therein a plurality of alloy metal anchors having a Y shape wherein there is a straight end and a forked end to the Y. The straight end has an end distal to the forked end wherein the distal end of the straight end of the Y is fixedly attached to the inside surface of the steel shell, such as, for example, by welding.

The steel shell is discontinuous at the point of the interface of the steel shell with the refractory material. The discontinuity has two, essentially parallel, near edges such that the steel shell has a narrow opening through its surface at this point.

There is also (V), a bellows expansion joint comprising a housing fixedly attached to the outside surface of the steel shell and essentially covering the steel shell at the point that the narrow opening through the steel shell exists. The housing is capable of carrying forced air through it.

The steel shell has a flat steel strip welded to the inside surface of the steel shell, near the discontinuity and on only one edge of the discontinuity such that when heated, the flat steel strip slides upon the inside surface of the steel shell, on the opposite edge of the discontinuity, to form a sliding expansion joint.

This invention further contemplates a multiple component heat exchanger that is an all-ceramic, air-to-air indirect heat exchanger having essentially a circular, square, or rectangular, configuration. The heat exchanger comprises in combination a first component (I) a first housing having two lateral sides, and having an exit end with a distal end and a near end, and an entry end having a distal end and a near end, which first housing is comprised of, for example, high temperature alumina firebrick. The first housing has a predetermined outside dimension and an outside surface.

Components (II) are tube sheets located at each of the exit end and the entry end of the first housing. The tube sheet, for purposes of discussion herein, has a round configuration, although they too can be configured as square, or rectangular. The tube sheets have an outside dimension, which dimension corresponds essentially to the outside dimension of the first housing.

The third component, (III), is an exit end housing having for purposes of the discussion herein, a circular configuration and an outside dimension essentially equivalent to the outside dimension of the first housing. The exit end housing has an outside surface and the exit end housing is aligned at the exit end near end to the first housing at their respective outside dimensions, the distal end of the exit end housing having an outside dimension smaller than the near end of the exit end housing.

The fourth component, (IV), is an entry end housing having, for purposes of discussion herein, a circular configuration and an outside dimension essentially equivalent to the outside dimension of the first housing. The entry end housing has an outside surface and the entry end housing is aligned at the entry end near end to the first housing at their respective outside dimensions, the distal end of the entry end housing having an outside dimension smaller than the near end of the entry end housing.

Component (V) is where the exit end housing and the entry end housing are covered with an insulating firebrick that conforms to the outside surface of each of the exit end housing and the entry end housing.

Component (VI) is a steel shell. The steel shell covers the entire outside surface of the first housing and has an inside surface. The exit end housing and the entry end housing are formed in a unitary shell such that there is formed a channeled opening, by the insulating firebrick covering of the first housing, the outside edge of the tube sheet, the insulating firebrick covering, respectively, of the exit end housing and the entry end housing, and the steel shell.

The channel has located therein a ceramic, crushable, gasket at the outside edge of the tube sheet. The channel also has located therein a refractory material which may contain therein a plurality of alloy metal anchors having a Y shape, the Y shape having a straight end and a forked end. The Y shape straight end has a terminal end which is distal to the forked end, wherein the terminal end is fixedly attached to the inside surface of the steel shell, for example, by welding.

Component (VII) is a bellows expansion joint comprising a housing fixedly attached to the outside surface of the steel shell and essentially covering the steel shell at the point that the refractory material meets the steel shell. The expansion joint is such that the housing is capable of carrying forced air and each said hollow expansion joint has at least one entry port and one exit port for the entry and exit of air, respectively.

In (VIII), the tube sheets support a plurality of ball joints, the ball joints being locked into the tube sheets using an inner tile and an outer tile and a friable, crushable gasket being located in a channeled opening formed by locking the inner tile and outer tile together.

In (IX), there are sufficient ceramic tubes supported on each end by the ball joints.

And finally, (X) represents plenum openings through each of the lateral sides of the first housing and extending through the steel shell, the insulating firebrick covering, and the high temperature alumina firebrick, to allow gas to enter one lateral opening and exit through the opposite lateral opening.

There is further contemplated within the scope of this invention, an improved manufacturing system which requires indirect heat transfer.

Specifically, there is contemplated within the scope of this invention an improved manufacturing system for manufacturing carbon black, the system comprising in combination: (i) a carbon black furnace; (ii) a primary quench cooler; (iii) a metal indirect air pre-heater; (iv) a secondary quench cooler; (v) a waste gas burner; (vi) a waste gas heater; (vii) at least one bag filter and, (viii) one or more all ceramic, air-to-air heat exchangers having as set forth just supra.

There is a considerable amount of sludge with a high water content produced in many industries, including pulp and paper and municipal sewage treatment plants. The inventive process described herein more closely fits the pulp and paper industries, because, for example, if the process were used by a municipality, all of the generated heat would be used to evaporate water, thereby eliminating the boiler, and there would be no lime injection system. The description herein is designed for pulp and paper sludge, but the invention herein should not be so limited, as this process is described as merely an example of the use of an all-ceramic heat exchanger in such processes.

Therefore, there is contemplated within the scope of this invention an improved system for sludge destruction requiring indirect heat transfer, the improvement comprising utilizing one or more all ceramic air-to-air heat exchangers of this invention in combination with: (A) a sludge feeder; (B) a wet sludge feed housing; (C) a hot air furnace; (D) a rotary kiln; (E) a dried sludge housing; (F) a dried sludge conveyor; (G) a dried sludge feed housing; (H) a rotary kiln combuster; (J) an ash housing; (K) a combustion air blower; (L) an ash conveyor and mixer; (M) a secondary combustion chamber; (N) a boiler; (O) a moisture content controller; (P) a lime injection system; (Q) one or more bag houses; (R) an induced draft fan and, (S) one or more all ceramic, air-to-air heat exchangers of this invention.

BRIEF DESCRIPTION OF THE DRAWINGS

FIG. 7 is a schematic diagram showing one type of a carbon black process using a heat exchanger of this invention.

DETAILED DESCRIPTION OF THE DRAWINGS

Figure 5A:
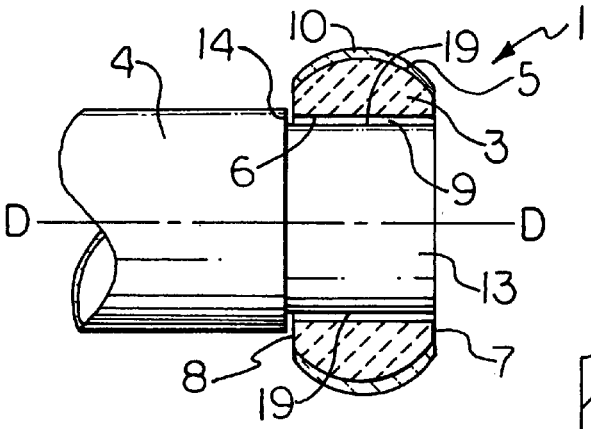
FIG. 5A is an enlarged cross-sectional view of a slidable ball joint of this invention taken through line C-C of FIG. 4 showing only the ball joint and the ceramic tube located therein.

Turning now to the Figures, and with regard to FIG. 5A, there is shown an enlarged cross-sectional view of a slidable ball joint 1 of this invention. The slidable ball joint assembly comprises in combination, a spherical body 3 and a ceramic tube 4.

The spherical body 3 has an outer surface 5 and an inner surface 6 and it has a near side 7 and a tube side 8. The near side 7 and the tube side 8 each have a center point shown by the line D-D. Each of the near side 7 and the tube side 8 have a truncated face to form a flat surface on them.

The spherical body 3 has an opening 9 of predetermined length, the predetermination being based on the amount of the reduced diameter end of the ceramic tube 4 that is required to be inserted into the opening in order that the spherical ball 3 can stabilize and support the ceramic tube 4.

The opening 9 in the spherical body 3 traverses the entire length of the spherical body 3 such that when air is passed through the ceramic tube 4, it can exit through the near side 7 and be collected thereafter.

The outer surface 5 of the spherical body 3 is covered with a thin, soft, woven, ceramic fabric 10, such fabrics being known by those skilled in the art and thus extended definition does not seem to be required herein. The fabric 10 is located between the spherical body 9 and the adjacent tiles, the inner tile 11 and the outer tile 12 (shown in FIG. 5B), such that when the inner tile 11 and the outer tile 12 are drawn together, the fabric 10 acts as a gasket, taking the configuration of the spherical body 3, and when heated, becomes ceramified.

The ceramic tube 4 has a predetermined outside diameter, said predetermination being based on the size of ceramic tubes 4 that are required for the design of the heat exchanger that they are intended to be used in. These ceramic tubes 4, and their required specifications, are well-known to those skilled in the art. The end 13 of the ceramic tube 4 has a smaller outside diameter than the outside diameter of the ceramic tube 4. The size of the outside diameter of the end 13 is based on the ability to insert the ceramic tube 4 into the spherical body opening 9.

As can be observed by reference to FIG. 5A, the ceramic tube 4 is inserted into the spherical body 9 from the tube side 8 and to the extent that it can reach the opposite side, i.e. the near side 7, or the ceramic tube 4 can be inserted into the spherical body 9 to an extent short of the near side 7. The shoulder 14, formed by the reduction in outside diameter of the ceramic tube 4 prevents the ceramic tube 4 from passing through and beyond the opening 9. However, there is no impediment to the movement of the ceramic tube 4 in the opposite direction, and in fact, that is the essence of one major embodiment of this invention, in that, upon heating, the ceramic tube 4 expands, and in so-doing, allows spherical body 9 to remain in place and keep the seal, without breaking the ceramic tube 4 or the spherical body 9. The spherical body 9 and the ceramic tube 4 are manufactured out of the same material such that their rate of expansion upon heating, and the rate of contraction upon cooling are essentially the same.

The outside surface 19 of the end 13 and the inner surface 6 of the spherical body 9 can be machined such that they have a tight fit with each other, but not so tight that the ceramic tube 4 cannot move within the opening 9. It is possible to use such ceramic tubes 4 that are formed in the indicated configuration without machining.

Figure 5B:
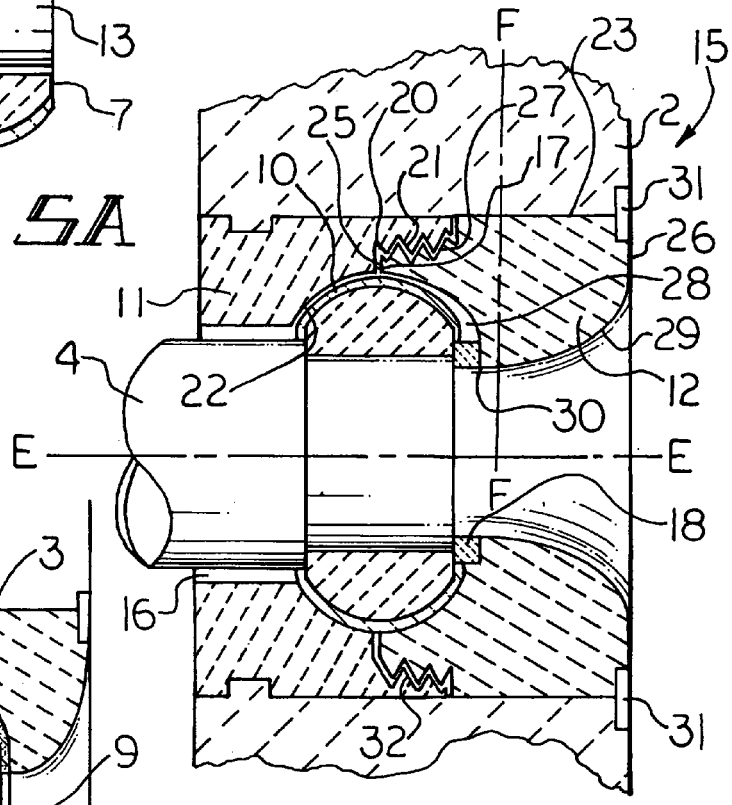
FIG. 5B is an enlarged cross-sectional view of a slidable ball joint assembly of this invention taken through line C-C of FIG. 4.

With reference to FIG. 5B, the slidable ball joint assembly 1 described just above is used in conjunction with other components to form an all-ceramic slidable ball joint system 15 comprising the combination of the slidable ball joint assembly 1, a tube sheet 2, an inner tile 11, an outside tile 12, and at least one friable, crushable annular gasket 18. The tube sheet 2 the inner tile 11, and the outside tile 12 are all ceramic bodies.

In this manner, the inner tile 11 and the outer tile 12 form part of the tube sheet 2. The inner tile 11 has at least one round opening 16 through it, said opening 16 having a center point shown by line E-E.

The inner tile 11 has an outside tile side 17 and an inside surface 20. The inner tile 11 has a first engagement and closure means 21 on the inside surface 20 and near the outside tile side 17. The inner tile 11 also has an arcuate notch 22 near the outside side 17 and in the inside surface 20, the arcuate notch 22 mating essentially with the spherical body outer surface 5 with the fabric 19 therebetween.

The other tile, the outside tile 12, has an outside tile top surface 23, an interior surface 24, a near end 25, a distal end 26 and a vertical midpoint shown by line F-F. The outside tile 12 also has a second engagement and closure means 27 that is located in the outside tile top surface 23. The second engagement and closure means 27 is intended to mate with the first engagement and closure means 21 of the inner tile 11. The outside tile 12 has a second arcuate notch 28 in the near end 25 and in the outside tile inside surface 20. The second arcuate notch 28 is intended to mate with the outer surface 5 of the spherical body 3. The outside tile 12 has a curved face 29 at its distal end 26 that begins at near the outside tile inside surface 20 and near the vertical midpoint F-F at about point 30.

The near side 25 of the spherical body 3 and the outside tile inside surface 20 near the spherical body 3 form a channeled opening between them to hold the gasket 18.

When the slidable ball joint assembly 15 is assembled, inner tile 11 is slipped over the ceramic tube 4, the ceramic tube 4 is slipped into the spherical body 3 and seated therein. Then, this part of the assembly is place into an opening in the tube sheet 2, a gasket 18 is then matched up against the ceramic tube end and then the outside tile 12 is threaded or Luer$^R$ locked into the inner tile 11 and tightened by using a tool in the notches 31. The tightening of the inner tile 11 and the outside tile 12 by means of the engagement and closure means 32 causes the gasket 18 to be crushed against the surface of the spherical body 3 and the fabric 10 to form a tight seal around the ball joint.

Figure 6:
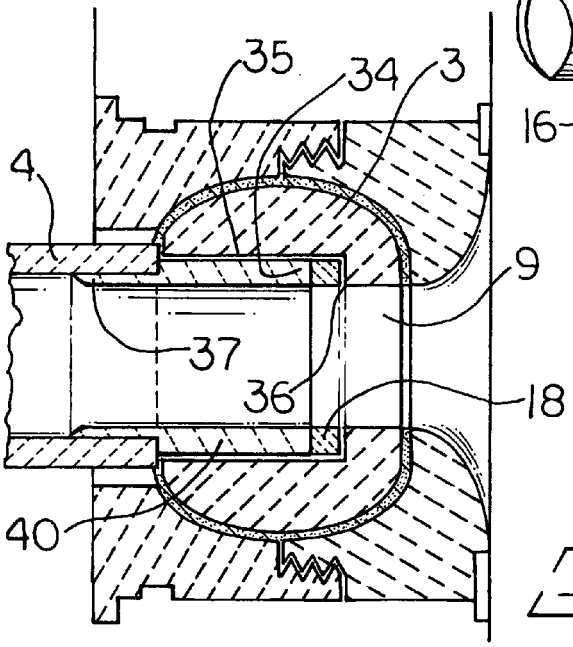
FIG. 6 is the enlarged cross-sectional view of FIG. 5, showing the tube seal extender of this invention in place.
Figure 4:
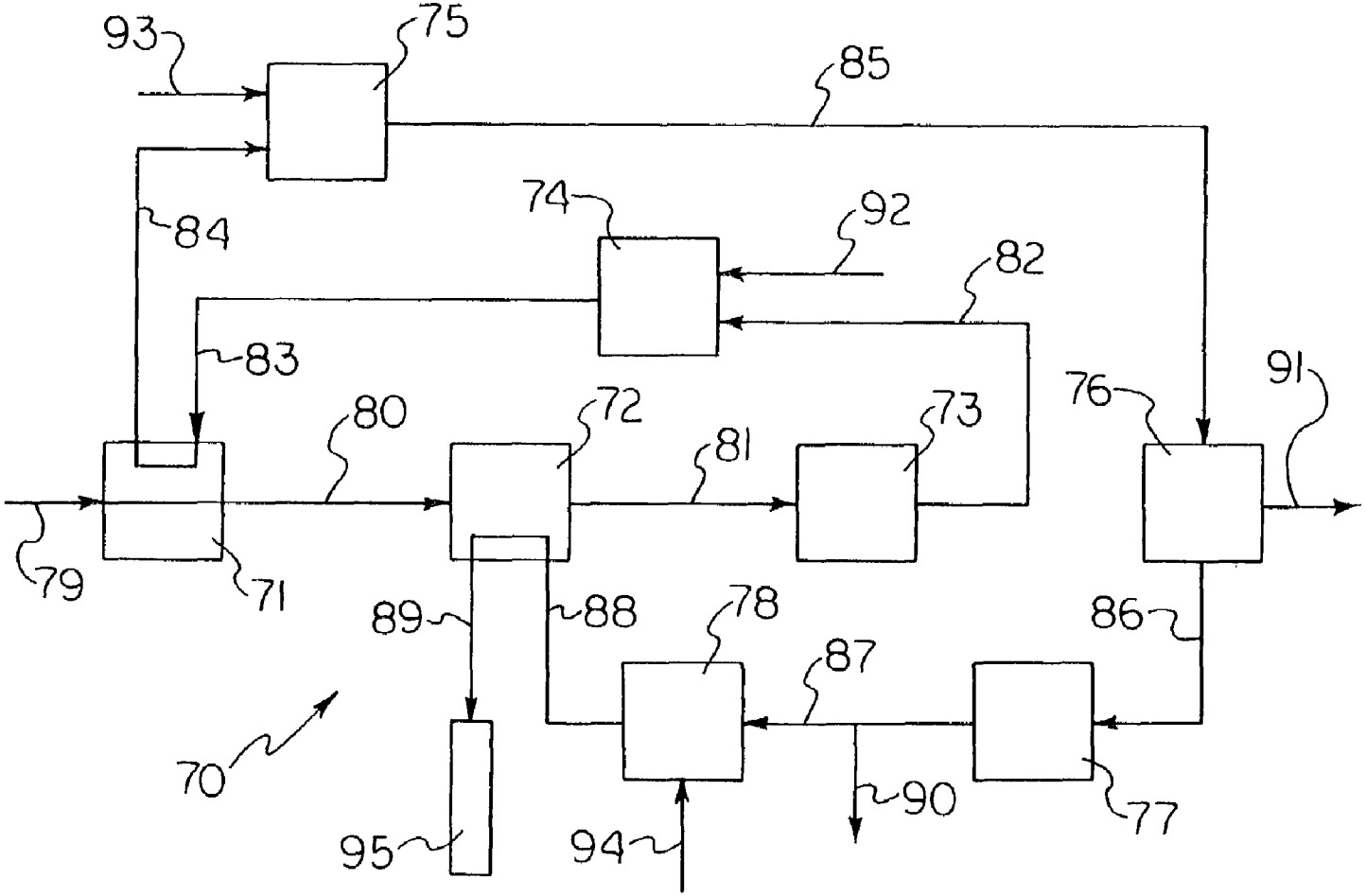

With reference to FIG. 6, there is shown another embodiment of this invention, which is the use of a tube seal extender 40 to support the ceramic tube 4 in the spherical body 3. The tube seal extender 40 has a tubular configuration and has a near end 34 and a distal end 37. The tube seal extender 40 has a predetermined outside diameter on its near end 34 that is small than the diameter of a second opening 35 in the spherical body 3. The tube extender is insertable into the second opening 35 of the spherical body 3 and it mates with the inner surface 6 of the spherical body 3. The distal end 37 has a predetermined outside diameter which is smaller than the inside surface of the ceramic tube 4. The distal end 37 is insertable into the ceramic tube 4 and mates with the inside surface of the ceramic tube 4. The near end 34 of the tube seal extender 40 compress the friable, crushable, annular gasket 18 which is located between them and near the near end 34 and the shoulder 36 located in the second opening 35 of the spherical body 3.

Figure 1A:
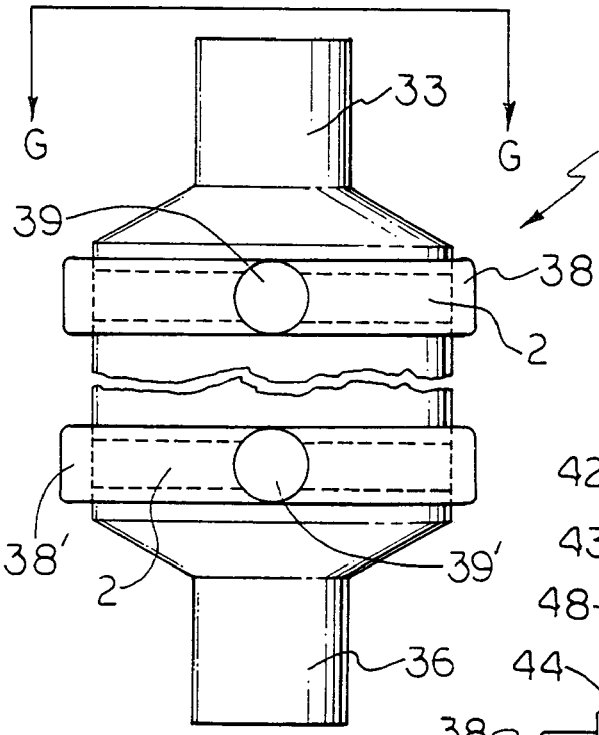
FIG. 1A is a fragmented top view of a heat exchanger of this invention showing an entry end and an exit end.

Turning now to FIG. 1A, there is shown a fragmented top view of a heat exchanger 50 of this invention. The view is reduced in size compared to the Figures of the slidable ball joint system and assembly presented in FIGS. 5A, 5B, and 6. There is shown the entry end 33 and the exit end 36 for the air that is processed by the heat exchanger 50. Also shown are two bellows expansion joint housings 38 and 38'. The housings 38 and 38' encircle the heat exchanger 50 and are fixedly attached to the steel shell (shown in FIG. 1B) of the heat exchanger 50, by for example, welding. Shown at the top of the housings 38 and 38' are exhaust vents 39 and 39' for venting cooling air from the housings 38 and 38'. Also shown in phantom are the tube sheets 2.

Figure 1B:
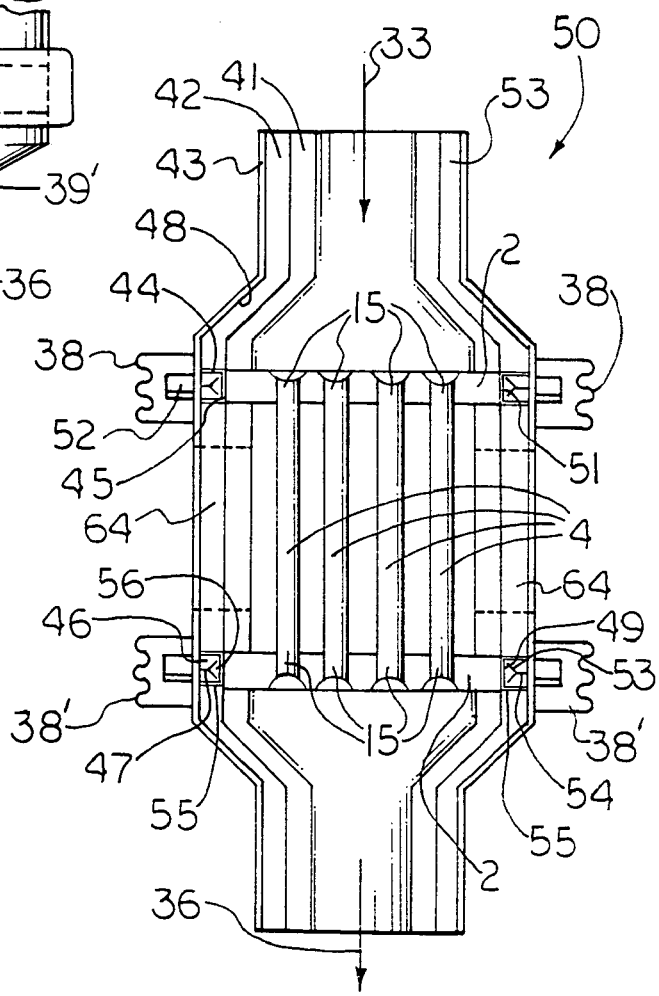
FIG. 1B is a cross-sectional view of a full heat exchanger taken through the line G-G.

Turning now to FIG. 1B, there is shown a full cross-sectional view taken through line G-G of FIG. 1A.

There is shown the tube sheets 2, ceramic tubes 4, a first firebrick wall 41, a second firebrick wall 42, a steel shell 43, a channel 44, bellows expansion joint housings 38 and 38'.

The tube sheets 2 can be manufactured from fired nitride-bonded silicon carbide shapes or castable refractory materials.

For purposes of this disclosure, the tube sheets 2 have a round configuration when viewed from the front of the heat exchanger 50. The significance of the round configuration is to prevent corners and other dead air spaces in the furnace as it is operating, although the tube sheets 2 can have any reasonable configuration.

Figure 2:
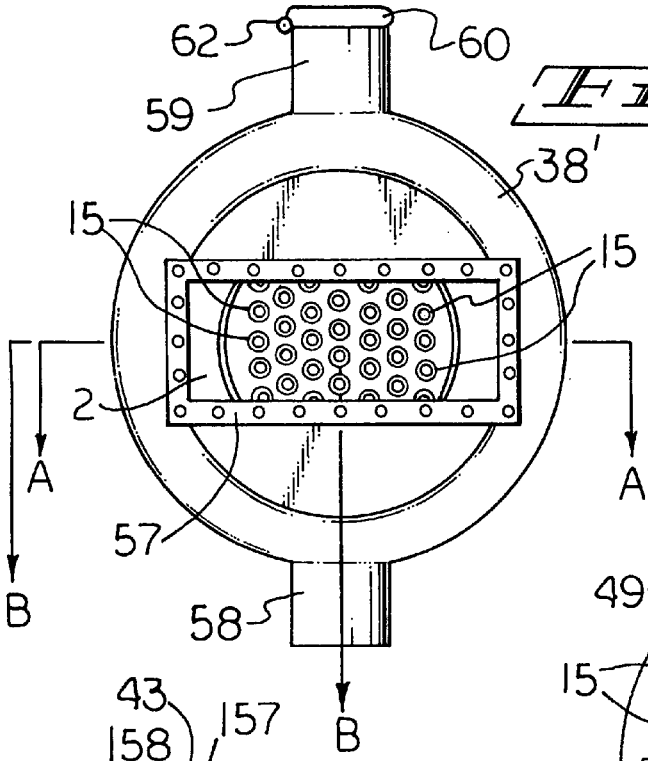
FIG. 2 is a full end view of a heat exchanger of this invention showing an air plenum in place.
Figure 3:
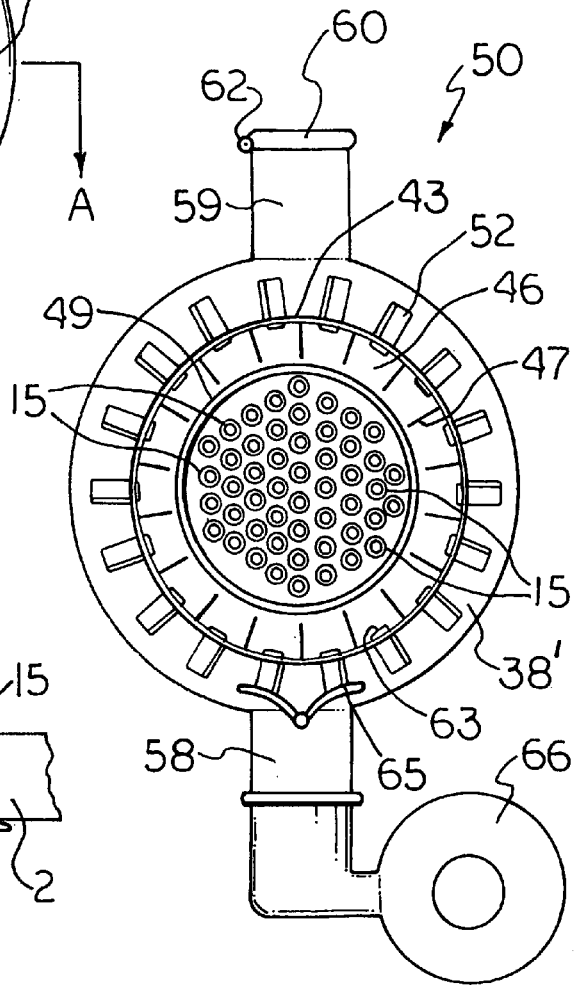
FIG. 3 is a cross-sectional view of the a heat exchanger of this invention taken through line A-A of FIG. 2 which is through a segment which is the bellows expansion joint.

The tube sheets 2 have an defined outside edge 45 and the tube sheets 2 have a plurality of circular openings 46 running transversely through them which are shown in FIGS. 2 and 3. The openings 46 each have contained therein, all-ceramic ball joint assemblies 15 as described supra.

A first firebrick wall 41 supports the tube sheets 2. This firebrick wall 41 is constructed from standard high alumina, super duty firebrick, or 3000° F. insulating firebrick. There is a second firebrick wall 42. The firebrick wall 42 is constructed from 2300° F. insulating firebrick. It should be noted that the tube sheets 2 are anchored in place by the first firebrick wall 41, as the firebrick wall 41 abuts both sides of the tube sheets 2.

Covering the entire surface of the heat exchanger 50 is a steel shell 43. It should be noted that the second firebrick wall 42 conforms to the outside surface of the first firebrick wall 41, and that the steel shell 43 conforms to the outside surface of the second firebrick wall 42, with the exception, that there are openings in the lateral walls of the heat exchanger to accommodate the flow of gases into and out of the heat exchanger 50 and, there are discontinuities in the steel shell at its interface with the refractory material to provide slidable expansion joints described infra.

There is a channeled opening 44 which is formed by the intersection of the outside edge 45 of the tube sheet 2, the insulating firebrick wall 42 on either side of the tube sheet 2, and the steel shell 43. This channeled opening 44 is filled with a castable refractory 46.

The refractory 46 has embedded in it, alloy metal Y-shaped anchors 47, which Y shape has a forked end 53 and a straight end 54 which has a distal, or terminal end 55, which anchors 47 are fixed, for example, by welding the distal or terminal end 55 to the inside surface 48 of the steel shell 43. These anchors 47 can be manufactured from high alumina, first quality refractory materials or other such materials used for this purpose. The purpose of these anchors 47 is not only to anchor the castable refractory material 46, but also to help conduct heat from the edge 45 of the tube sheet 2 to the steel shell 43 so that the heat can be moved to the housing 38, or 38', to allow for the removal of the heat. When softer, dense, low porosity, castable, refractory materials are used, the anchors 47 are used. When this material is hard, high alumina brick or the like, then the anchors 47 are not used. Prior to casting the refractory material 46, there is placed a ceramic gasket 49, on the outside edge 45 of the tube sheets 2, and the inside surface 51 of the refractory material 46.

Another embodiment of this invention is the use of alloy metal flashing 55 on the refractory material 46, which metal flashing 55 is located on the air side (both on the entry end housing 53 and the exit end housing 54) and between the ceramic wool gasket 49 and the refractory material 46 for up to about one-third of the surface of the back side 56 of the refractory material 46. The metal flashing 55 is best viewed on FIG. 4, and it can be observed, that there is a notch 160 that has been cut into the refractory material to accommodate the leading edge of the flashing therein.

Figure 4:
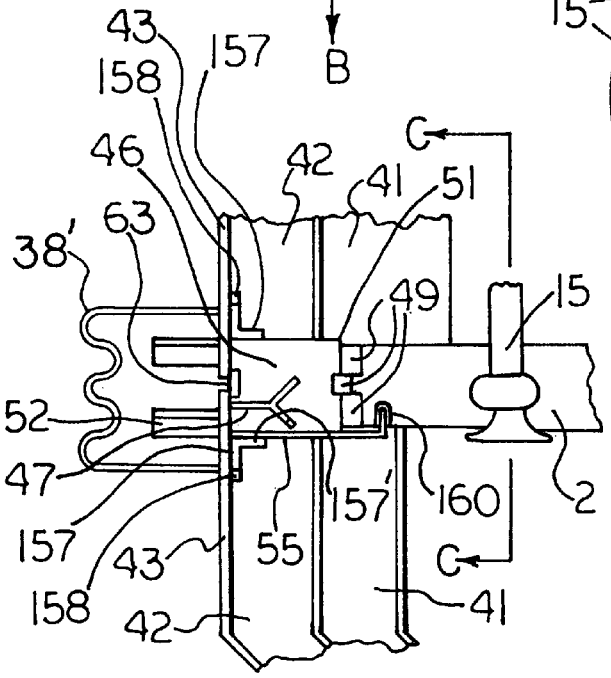
FIG. 4 is a partial cross-sectional view through line B-B of FIG. 1 showing an expansion joint.

With further reference to FIG. 4, there is shown a partial cross-sectional view through line B-B of FIG. 1 showing the expansion joint and showing the flat expansion joint 63 and radiators 52 in the bellows expansion joint housing 38'. The flat expansion joint 63 is a piece of flat steel welded to the inside surface 48 of the steel shell 43. There is a break or split in the steel shell 43 (i.e. the discontinuity) and the flat expansion joint 63 spans this break or discontinuity to provide expansion properties when the heat exchanger 50 is at high temperatures.

With reference to FIG. 2, there is shown a full end view of a heat exchanger of this invention showing tube sheet 2 containing slidable ball joint assemblies 15, a bellows expansion joint housing 38', a metal plenum mount 57, which can have any reasonable configuration, a forced air inlet 58, and a forced air outlet 59. There is also shown a lid or cap 60 for the exhaust outlet 59. It is contemplated by the inventor herein that the exhaust outlet cap 60 can be equipped with a mechanism 62 to allow the cap to automatically open or close under a given set of conditions. For example, if the forced air motor 61 (shown in FIG. 3) should happen to fail, the exhaust lid 50 would automatically open to allow passive air to exit through the exhaust outlet 59 so that the bellows expansion joint housing 38' and the other components within the housing 38' would not disintegrate due to the high heat of the heat exchanger 50. Failure to allow this passive air to move out of the exhaust outlet 59 would result in serious problems with the heat exchanger 50.

The bellows expansion joint comprising the housing 38 and/or 38' are constructed such that they have the ability to expand when the system is in high temperature conditions. The bellows expansion joint is full seam welded to the steel shell 43 and essentially covers the steel shell 43 at the point that the refractory material 46 meets the steel shell 43 (but for the existence of the gasket 49) and such that the housings 38 and 38' are capable of carrying forced air through them to permit low pressure, forced-air cooling of the tube sheets 2.

It will be noted that the housings 38 and 38' contain a plurality of heat radiators 52. The present invention provides for the use of the heat exchanger 50 without such radiators 52, however, the efficiency of the heat exchanger 50 can be enhanced by the use of such radiators 52.

It can be observed from FIG. 4 that there is an expansion joint built into the steel shell 43. The steel shell 43 has an opening (discontinuity) that is a slit or opening which encircles the heat exchanger at the point of the interface of the steel shell 43 with the refractory material 46 over the tube sheet 2.

There is a flat plate 63 welded onto the back surface of the steel shell, and along only one edge of the discontinuity. The other, or opposite edge of the steel shell 43 is not welded to the flat steel strip 63 and thus, when heated and expanded, the flat strip 63 slides over the inside surface of the steel shell 43 which provides for an expansion joint.

If desired, steel rods 157 and 157' are welded at points 158 and 158' to provide an anchor point for the refractory material 46.

The heat exchanger 50 has an entry end housing 53 and an exit end housing 54 and with reference to FIG. 1B, it can be observed that the end housings have smaller dimensions than the center of the heat exchanger. The purpose of the smaller dimensions of the end housing is so that the air being passed through them can be easily collected and also so that a metal plenum can be constructed over them for the same purpose.

Note also, that the housings 53 and 54 are constructed from firebrick walls 41 and 42, it being contemplated by the inventor herein that these firebrick walls can be constructed from firebrick having lower service temperature in view of the fact that the air moving into the heat exchanger 50 will not be as hot as the air exiting the heat exchanger 50. This means that less expensive brick can be utilized in such locations.

The inside of the heat exchanger 50 can be viewed in FIG. 3, which is a cross-sectional view of FIG. 2 at the bellows expansion joint housing 38'.

Thus, FIG. 3 thus shows the heat exchanger 50, the bellows expansion joint housing 38', the exhaust outlet 59, the lid 60, the lid mechanism 62, the steel shell 43, the heat radiators 52, the refractory material 46, the crushable gasket 49, the Y-shaped anchors 47, the slidable ball joint assemblies 15, the flat expansion joint 63, an air deflector 65, the forced air inlet 58 and an air blower with motor 66, the motor 66 not forming any part of this invention but is shown for clarification purposes.

Having set forth what the inventor believes is the invention with regard to the heat exchanger and its new and novel components and construction, there is contemplated in this invention the use of such heat exchangers in various industrial processes where an all-ceramic air-to-air indirect heat exchanger is required. The primary purpose of low to medium pressure exchanges has been to preheat combustion air. Combustion air blowers customarily operate between 1 psig and 2 psig. In industry, they generally list blower pressures in ounces, for example 16, 24, and 32-ounce blower pressures are standard. There are many chemical processes that can use the heat exchangers of this invention because such processes typically operate at differential pressures below 5 psig in processes that can tolerate a certain amount of leakage. Another factor to consider besides leakage is the potential for an explosion or rapid combustion if the leakage becomes excessive or a tube fails. As an example, if one were preheating combustion air and the air leaked into a methane or hydrogen laden flue gas, one could destroy the exchanger. The ceramic tubes will eventually wear out and some leakage is to be expected, so one would not recommend an exchanger where there is a danger if the two gases mix. Thus, there is sufficient reason to significantly reduce or eliminate leakage around the tubes and tube seals of a heat exchanger.

The heat exchangers of this invention lend themselves to incineration, carbon black manufacturing and some select chemical processes. When one wishes to destroy wet wastes, such as sludge and high-moisture garbage, one must raise the combustion chamber temperature above flammability limits (approximately 1500° F.) to insure complete combustion. In order to do this, one must insert a ceramic heat exchanger at the discharge of the secondary combustion chamber, before the blower, to preheat combustion air above about 800° F.

The secondary combustion chamber used in such a system is mandated by air quality code to operate at a minimum temperature of about 1800° F. The boiler will start to slag up at temperatures above 1500° F. Therefore, one must place the heat exchanger between the secondary combustion chamber and the boiler to drop the temperature from secondary code limits below the melting point of the fly ash. The heat is taken out and sent to the combuster. Since it is a closed-loop system there is little loss in efficiency, and one thereby meets the air quality code, protects the boiler, and raises the combustion chamber temperature high enough to burn off the hydrocarbons, despite the fact that one might have 75 to 90% of water in the waste.

In the carbon black units, one uses a metal heat exchanger to preheat the air to about 1600° F. This is about the temperature limit of a practical metal heat exchanger. The ceramic heat exchangers of this invention are used in tandem with the metal exchangers to raise the air temperature to 2200° F. from the flue gas temperature of about 2600° F. The present temperature limit of most ceramics is about 2800° F. One needs differential temperature between the flue gas and the air to transfer heat. Also, one needs 100° F. or 200° F. degrees of safety, so one ends up with a process wherein the furnace temperature is about 2600° F. and one can then preheat the air up to about 2200° F. This same process can be used in the chemical industry with the limitations that have been described supra.

Each year, the U.S. chemical industry produces approximately eight billion pounds of methanol. This methanol is produced by a series of process steps, including "steam/methane reforming". The actual output of this reforming process is an intermediate product known as "syn gas" (synthesis gas), which is prepared by catalytically reacting a mixture of natural gas (mostly methane) and steam at high temperatures in a "reformer". The synthesis gas consists mainly of carbon monoxide and hydrogen and is subsequently converted to methanol or one of a number of other products.

Convention reformers (radiant type furnaces) use metal heat exchanger tubes, which limits the outlet temperature of the syn gas to about 1600° F. This in turn limits the yield of the gas. The development of a heat exchanger that could tolerate significantly higher temperatures would not only increase the yield beyond about 85%, but would also result in lower natural gas requirements to produce the same amount of syn gas. Such a heat exchanger is one subject of this invention.

Thus, one embodiment of this invention is the use of the heat exchangers of this invention in industrial processes, and especially, chemical processing, sludge destruction, and carbon black production.

With reference to FIG. 7, there is shown an improved manufacturing system 70 for manufacturing carbon black and other like products. For purposes of clarification, the temperatures are stated to be average and are for identification purposes only and should not be construed as limiting the invention otherwise set out herein. The process described infra deals with the handling of the air, combusted and waste gases, and is not necessarily intended to describe the handling of the materials that result in the production of the useful product, such as carbon black.

The FIG. 7 is a schematic of such a system and comprises in combination an air preheater 71 that preheats existing air 79 for movement to the all-ceramic heat exchanger 72 of this invention. The feed to the system is on the order of 150,000 SCFH ambient air 79. The air exiting the air preheater 80 has a temperature on the order of 850° F. and is feed into the heat exchanger 72 at about that temperature. The air 81 exiting the heat exchanger 72 is on the order of about 2000° F. and this heated air 81 is fed into a carbon black furnace 73 for incinerating hydrocarbons into carbon black and provides a substantial amount of waste gas 82 in the process. The waste gas 82 is then fed into a primary quench cooler 74, which is cooled with primary quench water 92 to provide a reduction in the temperature of the waste gas to about 850° F., this waste gas being 83.

The waste gas 83 is then fed back into the air preheater 71 and exhausts as 800° F. waste gas 84 which is fed into a secondary quench cooler 75, which is cooled by secondary quench water 93, which results in exiting 500° F. waste gas 85. This waste gas 85 is then fed to the bag filters 76 to trap any particulate materials still residing in the waste gas 85 that results in a small reduction in the temperature of the waste gas 85 to provide 450° F. waste gas 86. Waste gas 86 is then fed into a waste gas heater 77 that preheats the waste gas 86 to provide waste gas 87 that is then either fed into a waste gas burner 78, or is siphoned off of the system at 90 as being unused waste gas.

Natural gas 94, in combination with air, is used as fuel to burn off the waste gas 87, which provides a 2600° F. combusted waste gas 88 which is fed into the all-ceramic exchanger 72 to help heat the 850° F. air 80 coming from the air preheater 71.

By being treated with the all-ceramic heat exchanger 72 of this invention, the combusted waste gas 88 is reduced in temperature to about 1880° F. and exhausted through a stack. The all-ceramic heat exchanger 72 of this invention is especially capable of handling the combusted waste gas at 2600° F., about 1000° F. above where a metal heat exchanger would disintegrate.

Figure 8:
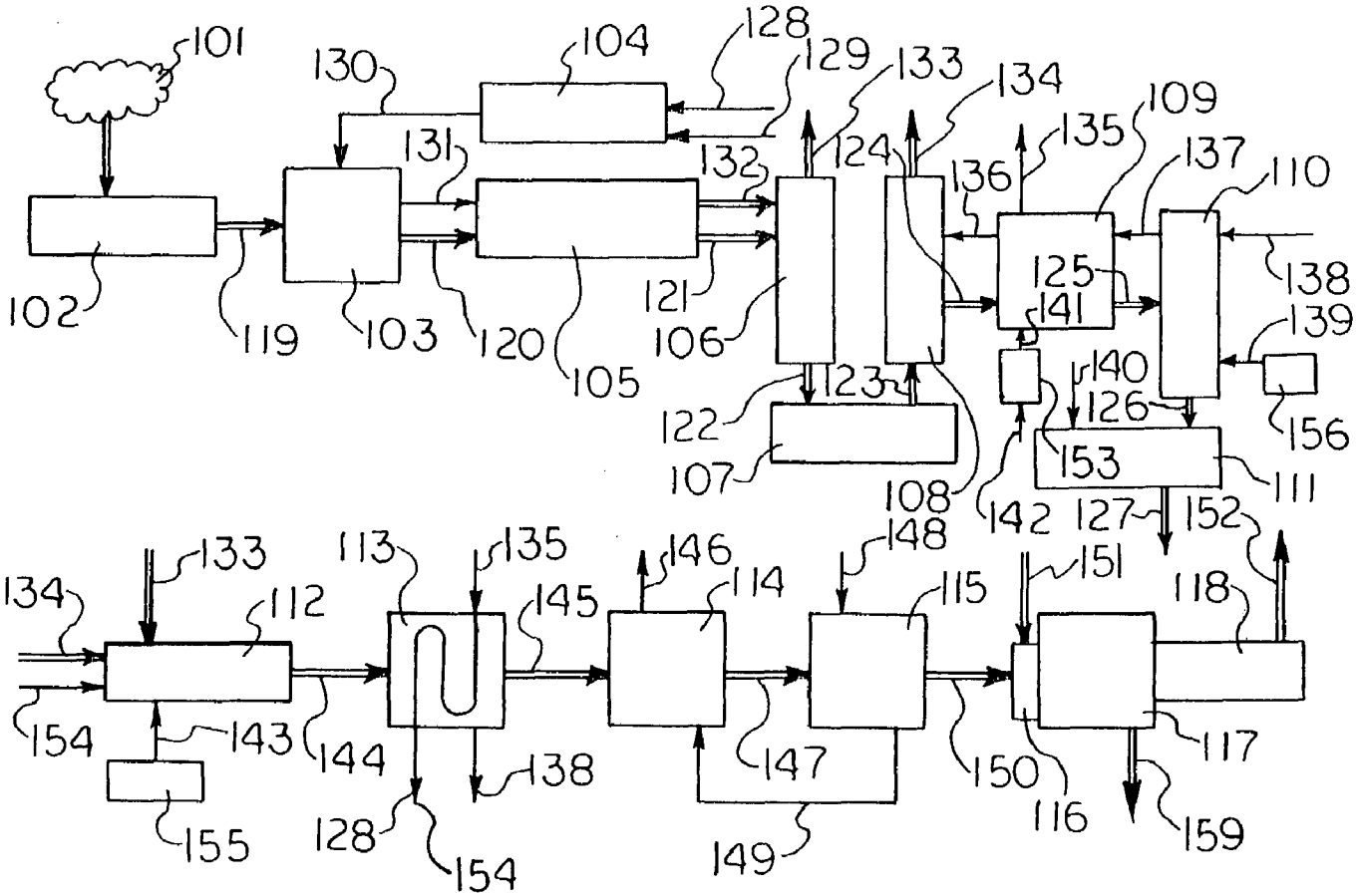
FIG. 8 is a schematic diagram showing one type of sludge conditioning process using a heat exchanger of this invention.

Turning now to the sludge destruction process and with reference to FIG. 8, there is shown a sludge destruction process 100 as a schematic diagram.

The sludge, containing a high water content is shown at 101 and is moved into a feeder 102. The feeder 102 is a standard piece of equipment that will screw-convey the wet sludge material at 119 at a constant rate into the primary combuster 4. The feeder 102 is constructed of alloy metal and must be designed in direct connection with a down stream shutoff valve. The shutoff valve prevents flashbacks and/or explosions.

There is a feed housing 103 which contains rotary kiln seals, an inlet port for preheated combustion air, and a valve assembly that will automatically prevent flashbacks into the feed, the rotary kiln seals, the inlet port and the valve assembly not specifically claimed in the claims appended hereto.

The sludge 101 in the feed housing 103 is subjected to 1200° F. air 130, which comes through a stabilizing hot air furnace 104 which is fed the 1200° F. air from the all-ceramic heat exchanger 113. The stabilizing hot air furnace 104 is also fed auxiliary fuel 129 for an auxiliary fuel burner housed therein (not shown), for start-up and temperature control of the hot air 128 coming from the heat exchanger 113. The heated (about 70° F.) sludge 120 is further conveyed into a rotary kiln combuster 105, which combuster 105 is also fed 1200° F. air from the housing 103. The rotary kiln combuster 105 is intended to be a parallel flow, starved air, standard rotary kiln which mixes the preheated combustion air 131 and the sludge 120 and evaporates the moisture and light-end volatiles at temperatures of about 1600° F. maximum inlet, and control the flue gas discharge 133 at about 400° F. out of the housing 106 by way of a flue gas duct (not shown), by regulating the temperature and amount of combustion air. The 400° F. temperature is high enough to insure vaporization of the water from the lower content sludge 121. The heat for this vaporization arrives from the rotary kiln combuster 105 as flue gas 132.

The dried sludge 122 is then moved to a dried sludge lift conveyor 107 which is a standard device constructed of hardened steel and which can operate at temperatures up to about 700° F. Its function is to lift the dried sludge 122 into the second combustion kiln assembly 109. There is a second feed housing 108 which houses the lift conveyer 107, the rotary kiln seals (not shown) and a flue gas discharge duct 134. The dried sludge 124 exits the housing 108 at about 400° F. and moves into the rotary kiln combuster 109 at that temperature. The heated air 138 for the second feed housing 107 and the rotary kiln combuster 109, is provided from the heat exchanger 113, the temperature of the air 138 from said heat exchanger 113 being on the order of about 600° F. as it enters an ash housing 110, and as it moves through the ash housing 110 and into the rotary kiln combuster 108, the air temperature 137 is still about 600° F.

The rotary kiln combuster 109 is a counter flow, air-cooled, starved air rotary kiln. It takes the 400° F. sludge 124 and combusts the remaining volatiles and fixed carbon by counter flowing preheated combustion air up the kiln in a manner that the ash 127 discharging from the kiln is equal to or lower than the preheated air inlet temperature. The discharge temperature of the flue gas is at or below the initial softening temperature of the fly ash. The process is controlled by the amount and temperature of air that is introduced into the rotary kiln 109. The percentage is always on the starved air side because dried sludge burns at temperatures above 2000° F. and forms considerable slag, which is to be avoided.

There is a combustion air blower 153 that provides forced cooling air between the shells of the rotary kiln 109. The air is collected at a bustle (not shown) on the feed end and conveyed to the ceramic, air-to-air heat exchanger 113 by a duct 135. This air handling system accomplishes three unique functions, namely the rotary kiln shell is cooled to protect the steel, the rotary kiln seals are pressurized, any leakage goes into the process as combustion air, and any heat collected is returned to the process through the heat exchangers and, subsequently to the burners.

The sludge 126 is then moved by the ash conveyor/mixer 111 into the bag house 117. The ash conveyor/mixer consists of, for example, a standard rotary screw conveyor, coupled to spray nozzles that wet down the ash and combine the spent lime and fly ash that is collected from the bag house 117. The rotary screw conveyor and spray nozzles and that system are not shown.

There is a secondary combustion chamber 112 that takes the 400° F. flue gas 133 from the first rotary kiln 105 out of the dried sludge housing 106. Within the secondary combustion chamber 112, the flue gas 133 is mixed with the 1200° F. flue gas 134 out of the feed housing 108, and these two starved air volatiles are combined with preheated combustion air 153 from the ceramic heat exchanger 113. If the secondary combustion chamber exit temperature flue gas 144 temperature is required by code to be at least 1800° F., the entire mixing process takes place at the front end of the secondary combuster 112.

There is, in addition, an auxiliary fuel burner 155 for start-up and stabilization heat 143. The auxiliary fuel burner will handle 1200° F. combustion air.

The ash housing 110 contains an auxiliary fuel burner 156, kiln seals and an ash screw conveyor (none of the kiln seals and ash screw conveyor are shown), the auxiliary fuel burner 156 feeds heat air 138 to the ash housing 110. The auxiliary fuel burner 156 has the capacity to preheat the kiln 109 to minimum start-up temperature and operate on pilot only so that the maximum amount of auxiliary fuel does not exceed about 1 to 3 percent of the gross system heat capacity.

The component 113 is a multi-pass heat exchanger of this invention. It permits the replacement of tubes, provides for soot blowing, and deslagging by high temperatures, because of its design.

The heat exchanger 113 is the essence of the process in that it provides two vital process enhancements. First, it preheats combustion air to temperatures well above metal designed heat exchangers, and secondly, it drops the flue gas temperature below the slag forming temperature, thereby permitting the use of a standard waste heat boiler. Since the process is a closed-loop system, there is no loss in efficiency because essentially all of the heat is returned to the process. It provides heated air 145 at a temperature of about 1500° F. to the boiler 114. It further receives flue gas 135 from the housing 108. Yet still, as discussed above, it provides 1200° F. air to the heat furnace 104 and to the secondary combustion chamber 112.

Component 114 is a standard waste heat, water tube boiler with soot blowers and non-essential trim. The boiler 144 has the capacity to provide steam 146 which can be used in the process or can be taken to another process to provide energy.

Component 115 is an economizer. When the moisture content of the sludge is below about 75%, there is sufficient heating value to use an economizer, which heats the feed water 148 and drops the flue gas temperature low enough to permit the use of standard fabric filters in the bag house 117. The economizer 115 provides water 149 to the boiler 114, as well. In operation, the flue gas water percentage should be at a level to permit maximum acid removal from the system. When the water percentage gets too high for efficient removal of acids, the economizer is deleted and is replace by an air injection system (not shown) that would bring sufficient air from the heat exchanger 113 to control the water percentage at a temperature to protect the fabric filters and still have optimum acid removal. The flue gas 150 moving from the boiler 115 is at a temperature of about 450° F.

There is further shown a lime injector 116, which injects lime 151 directly into the flue gas and thereby neutralizes the acids present therein. The lime can be injected either as dry lime or as slurry directly into the flue gas.

The bag house 117, described supra, uses a standard fabric filter to collect fly ash and salts in hoppers (not shown), The filters are connected to a closed ash conveyor system 111 which sends these materials to an ash treatment mixer for further processing (also not shown).

There is finally shown an induced draft fan/stack unit 118. The entire process described supra is a negative draft, controlled system. The starved air rotary kilns 105 and 109 are maintained at approximately minus ¼" w.c. and the induced draft fan (not shown) in the unit 118 is large enough to hold the ¼" w.c. pressure and compensate for the pressure drops in all the pieces of equipment.

If the water percentage of the flue gas 152 at this unit 118 is high, and there is a chance of rain from the stack discharge, additional heated air is injected at the fan intake to reduce the fallout.

The process described just supra is superior to all systems presently used to treat sludge because it does not require auxiliary fuel except for start-up and pilots, or a separate process for the pre-drying of the sludge, and it meets all air quality and solid waste discharge codes.

What is claimed:

1. An improved manufacturing system for manufacturing carbon black, said system comprising in combination:

(i) a carbon black furnace;

(ii) a primary quench cooler;

(iii) an air pre-heater;

(iv) a secondary quench cooler;

(v) a waste gas burner;

(vi) a waste gas heater;

(vii) at least one bag filter and, (viii) one or more all ceramic, air-to-air heat exchangers comprising in combination:

(I) a first housing having two lateral sides, and having an exit end with a distal end and a near end, and an entry end having a distal end and a near end, which first housing is comprised of high temperature alumina firebrick, said first housing having a predetermined outside dimension, said first housing having an outside surface;

(II) a tube sheet located at each of the exit end and the entry end, said tube sheet having an outside dimension, which corresponds essentially to the outside dimension of the first housing;

((III) an exit end housing having an outside dimension essentially equivalent to the outside dimension of the first housing, said exit end housing having an outside surface; said exit end housing being aligned at the exit end near end to the first housing at their respective outside dimensions, the distal end of the exit end housing having an outside dimension smaller than the near end of the exit end housing;

(IV) an entry end housing having an outside dimension essentially equivalent to the outside dimension of the first housing, said entry end housing having an outside surface, said entry end housing being aligned at the entry end near end to the first housing at their respective outside dimensions, the distal end of the entry end housing having an outside dimension smaller than the near end of the entry end housing;

(V) said exit end housing and entry end housing being covered with an insulating firebrick which conforms to the outside surface of each of the exit end housing and the entry end housing;

(VI) a steel shell, said steel shell covering the entire outside surface of the first housing and having an inside surface, the exit end housing and the entry end housing formed in a unitary shell such that there is formed a channelled opening by the insulating firebrick covering of the first housing, the outside edge of the tube sheet, the insulating firebrick covering, respectively, of the exit end housing and the entry end housing, and the steel shell; said channel having located therein a ceramic, crushable, gasket at the outside edge of the tube sheet; said channel having located therein a refractory material;

said steel shell being discontinuous at the interface of the steel shell with the refractory material;

said discontinuity having two, essentially parallel, near edges;

(VII) a bellows expansion joint comprising a housing fixedly attached to the outside surface of the steel shell and essentially covering the steel shell at the point that the refractory material meets the steel shell and such that the housing is capable of carrying forced air therethrough;

said steel shell having a flat steel strip fixedly attached to the inside surface of the steel shell, near the discontinuity and on only one edge of the discontinuity such that when heated, the flat steel strip slides upon the inside surface of the steel shell on the opposite edge of the discontinuity, to form a sliding expansion joint;

each said bellows expansion joint having at least one entry port and one exit port for the entry and exit of air, respectively;

(VIII) said tube sheets supporting a plurality of ball joints, said ball joints being locked into the tube sheets using an inner tile and an outer tile and a friable, crushable gasket being located in a channeled opening formed by locking the inner tile and outer tile together;

(IX) sufficient ceramic tubes supported on each end by the ball joints;

(X) Plenum openings through each of the lateral sides of the first housing and extending through the steel shell, the insulating firebrick covering, and the high temperature alumina firebrick, to allow gas to enter one lateral opening and exit through the opposite lateral opening.

2. An improved manufacturing system for manufacturing carbon black of claim 1, in which the ceramic, air-to-air indirect heat exchangers contain a ball joint which is a slidable ball joint.

3. An improved manufacturing system for manufacturing carbon black of claim 1, in which the ceramic, air-to-air indirect heat exchangers contain a ball joint which is non-slidable.

4. A process for manufacturing carbon black, the process utilizing the system of claim 1.

5. A process for manufacturing carbon black as claimed in claim 4 wherein the ball joints of the system are slidable ball joints.

6. A process for manufacturing carbon black as claimed in claim 4 wherein the ball joints of the system are non-slidable ball joints.

* * * * *